United States Patent [19]

Moore et al.

[11] Patent Number: 4,494,123

[45] Date of Patent: Jan. 15, 1985

[54] SELF-ERECTING COMPOSITE ANTENNA STRUCTURE

[75] Inventors: Larry A. Moore; John S. Walker, both of Scottsdale, Ariz.

[73] Assignee: Motorola, Inc., Schaumburg, Ill.

[21] Appl. No.: 520,766

[22] Filed: Aug. 8, 1983

Related U.S. Application Data

[63] Continuation of Ser. No. 399,076, Jul. 16, 1983, abandoned, which is a continuation of Ser. No. 190,675, Sep. 25, 1980, abandoned.

[51] Int. Cl.[3] ..... H01Q 9/30; H01Q 1/08

[52] U.S. Cl. ..... 343/900; 343/715

[58] Field of Search ..... 343/709, 710, 715, 873, 343/900

[56] References Cited

U.S. PATENT DOCUMENTS

| | | | |
|---|---|---|---|
| 2,758,203 | 8/1956 | Harris | 343/101 |
| 3,248,689 | 4/1966 | Shomphe et al. | 343/709 |
| 4,134,120 | 1/1979 | DeLoach et al. | 343/715 |

*Primary Examiner*—Eli Lieberman

*Attorney, Agent, or Firm*—Eugene A. Parsons

[57] ABSTRACT

A composite antenna element formed of a plurality of high modulus, high strength, low density, unidirectional graphite fibers bonded together by a flexible matrix material and formed into a tapered rod. The element is stored in a coiled configuration within a groove on the device to which it is attached and uses the strain energy stored within it during coiling to uncoil itself upon release into a vertical cantilever column on the order of eight feet high.

6 Claims, 4 Drawing Figures

SELF-ERECTING COMPOSITE ANTENNA STRUCTURE

The United States Government has rights in this invention pursuant to contract number DAAB07-78-C-3617 awarded by the Department of Defense.

This is a continuation of application Ser. No. 399,076, filed July 16, 1983 which is a continuation of Ser. No. 190,675 filed Sept. 25, 1980, both abandoned.

BACKGROUND OF THE INVENTION

The present invention relates to antenna structures and in particular to self-erecting whip antenna structures.

Self-erecting antennas are often used in situations where stowage space is limited and where deployment must occur unattended by a human operator. The need to deploy a vertical antenna several feet long from a relatively small unattended electronic device, such as an expendable RF transmitter and receiver, poses special problems. Package size and geometry constraints coupled with operational requirements for such a device typically call for an antenna which has the following characteristics:

1. Self-erecting.
2. Capable of being collapsed and stowed in a relatively small volume.
3. Self-supporting against gravitational loading after erection.
4. Capable of remaining erect and functional when exposed to moderate winds and/or when the device to which it is attached is situated on a non-horizontal surface.
5. Incapable of causing the device to which it is attached to be overturned or displaced during antenna deployment and/or during exposure to moderate wind after erection when the device is situated on either a horizontal or nearly horizontal surface.
6. Low visual profile.

Providing a relatively long antenna with such characteristics for a small electronic device pits the requirements for sufficient strength and elasticity to allow stowage and self-erection against the requirements for section stiffness sufficient to prevent excessive flexure or instability (i.e., buckling). In addition, geometric section properties required to prevent instability of relatively long whip antennas subject to gravitational and wind loading are pitted against geometric section properties required to minimize the overturning moment produced by wind loading (i.e., minimize wind drag area) and produce a low visual profile.

One approach to self-erecting antenna structures entails the use of a strip of metal coiled on a storage reel. When released, the strip uncoils into a length of flat metal suitable for use as an antenna. This type of design suffers from a propensity to buckle when exposed to wind loading or gravitational self-loading at lengths of several feet.

In a variation of the coiled metal strip approach, typified in U.S. Pat. No. 3,144,104, an elongated strip is permanently deformed into a hollow tube. The tube is then temporarily opened flat and coiled on a reel. When the reel is released, the strip uncoils and reforms into a tubular shape.

Another variation, typified in U.S. Pat. No. 3,467,329, involves a helically prestressed strip of metal, formed so that adjacent turns are set to coil tightly in an overlapping and telescoping engagement. The strip of metal is wound into a cylindrical coil for storage. When released, the strip uncoils and reforms into a spirally wound, slightly tapered tubular shape.

In both of these variations, in order to prevent buckling due to wind loading or due to self-loading at lengths of several feet, an increase in the cross section of the tubular antenna structure has been required. In these devices, buckling is a "nonhealing" condition and constitutes practical destruction of the antenna structure. Unfortunately, cross sections that are sufficient to prevent buckling due to wind loading or gravitational self-loading are also enough to cause overturning of relatively small devices to which the antennas may be attached. Relatively small devices are also overturned by wind or self-loading of such antenna structures when the devices are placed on surfaces that are not horizontal, and such devices can even be overturned by the energy released during the erection of the antenna. Furthermore, a large cross section also presents a higher visual profile than is desirable where visual unobtrusiveness is required.

Another approach to preventing flexure has been to use stiffer materials to form the antenna structure. As revealed in French Pat. No. 2,312,864, and U.S. Pat. No. 4,134,120, graphite filaments can be used to increase the stiffness of an antenna. However, the antennas described have bending stiffness properties (i.e., modulus of elasticity and moment-of-inertia) which make them too stiff to be coiled so that they can be conveniently stowed in a relatively small volume and can still subsequently use the strain energy stored during coiling to enable them to be self-erecting. In fact, their strength/elasticity properties and described length/diameter ratios would preclude storage in a coiled form of any reasonable diameter.

In an attempt to solve problems of bending due to thermal stress such as found in a space environment it has been suggested the coiled strip and graphite composite approaches could be combined. U.S. Pat. No. 3,975,581 discusses the use of composite prestressed tapes constructed to unfurl into a strip or tube for use as a boom or as a support for coaxial transmission lines. Long structures constructed according to this suggestion would tend to overturn relatively small devices to which they were attached if use were attempted in an earth environment and would not possess an optimally low visual profile.

All of the approaches discussed above require a greater volume for stowage than is desirable for use in relatively small devices. None of the designs could meet the simultaneous constraints of elasticity, stiffness, low mass, elastic stability, low visual profile and low aerodynamic drag area imposed on self-erecting antennas for use with relatively small devices in an earth environment.

SUMMARY OF THE INVENTION

Accordingly it is an object of the present invention to provide a new self-erecting antenna.

A further object is to provide an antenna which can be stowed in a relatively small volume by winding into a relatively small coil.

Another object is to provide a self-erecting antenna which can support its own gravitational loading when erected in a column several feet long with one end clamped and the other end free.

Yet another object is to provide a self-erecting antenna which can withstand moderate wind loading without structural damage or collapse due to instability and which can recover full capacity after wind loading abates.

Yet a further object is to provide a self-erecting antenna which will not cause the device to which the antenna is attached to be overturned during deployment or during exposure to moderate wind after erection.

An additional object is to provide a self-erecting antenna which will not cause the device to which the antenna is attached to overturn and which will remain functional when the device is on a reasonably nonhorizontal surface.

Still a further object is to provide an antenna which has a low visual profile.

These and other objects of the present invention will become apparent to those skilled in the art upon consideration of the accompanying specification, claims and drawings.

In order to attain the above-mentioned objects, the present invention comprises a composite antenna element formed of a plurality of unidirectional, high modulus, high strength, low density, graphite fibers bonded together by a flexible matrix material and formed into a tapered rod, the antenna element being stored in a coiled configuration within a retainer on the device to which it is attached. The antenna element uses the strain energy stored within it during coiling to uncoil itself upon release into a vertical cantilever column several feet high.

BRIEF DESCRIPTION OF THE DRAWINGS

Referring to the drawings in which like reference numerals indicate like structures.

DESCRIPTION OF THE PREFERRED EMBODIMENT

Figure 1:
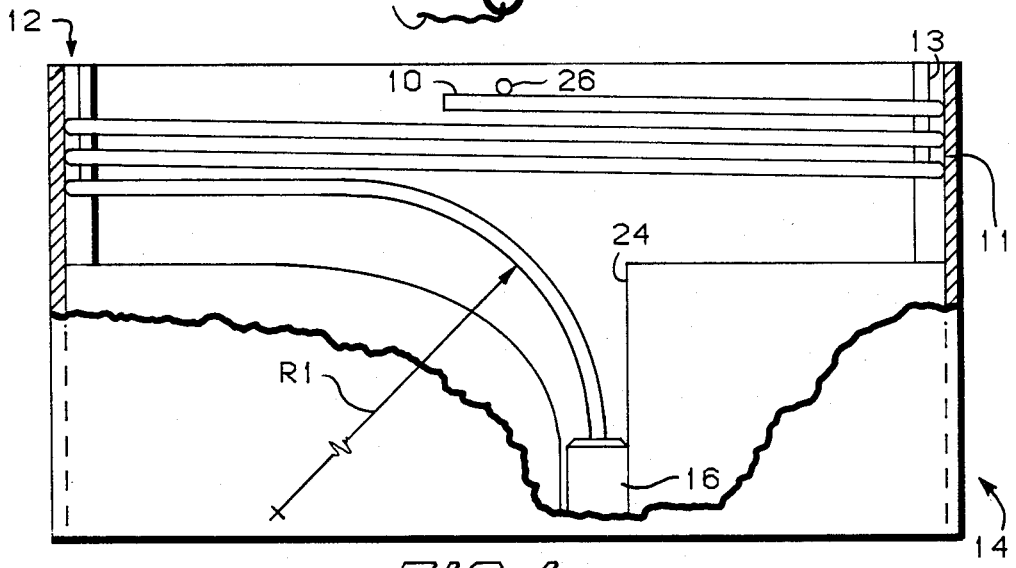
FIG. 1 is a side view of an embodiment of the present invention with a portion of the outer surface cut away to reveal the embodiment in its coiled configuration.

In an embodiment of the self-erecting antenna structure as illustrated in FIG. 1, antenna element 10 (shown untapered for clarity) is shown stowed in its coiled configuration. Antenna element 10 is preferably composed of a composite material.

In the preferred embodiment the composite element is a pultruded rod containing from about 63 to about 83 percent (by volume) unidirectional graphite fiber, such as the fiber sold under the trademark Magnamite and obtainable from Hercules, Inc. Salt Lake City, Utah, or the fiber sold under the trademark Celion 6000 and obtainable from Celanese Corporation, Chatham, N.J., embeded in a vinyl ester resin matrix material, such as the resin sold under the trademark Hetron 902 or the resin sold under the trademark Hetron 903 both obtainable from Ashland Chemical Company, Polyester Division Columbus, Ohio. Each graphite fiber is approximately 7 to 8 microns in diameter and there are approximately 30,000 full length individual fibers uniformly dispersed within the cross-sectional area of the untapered rod. The untapered rod is fabricated by a pultrusion process in which bundles of graphite fibers are wetted with a resin matrix and pulled through a heated die which simultaneously produces the desired cross-sectional shape and cures the matrix material. Processes for forming pultruded graphite rods are well known in the art and will not be described further. Such rods as described herein are obtainable, for example, from the Graftek Division of Exxon Enterprises, Inc., Raleigh, N.C.

The rod used in the preferred embodiment has an elastic flexural modulus of about $20.6\times10^6$ psi and has an average tensile strength of about 315,000 psi. Such an untapered rod, about 0.06 inches in diameter, can free stand as a cantilever column to a height of 7 feet in still air and can be wound in a 4.7 inch diameter for stowage. A high ratio of length to diameter, for example, a ratio of 1400:1 in the 7 foot rod described above, is a feature which both distinguishes the present invention from other antenna structures employing graphite fibers and cooperates in the coiling and self-erection of the antenna of the present invention.

Untapered rods containing lower graphite fiber volumes can support self-loading in shorter antenna elements. For example, when graphite fibers with a flexural modulus of elasticity of $17.4\times10^6$ psi and an average tensile strength of 280,000 psi are used, a graphite fiber volume of about 50 percent allows a rod of about 4 feet, 10 inches in length and about 0.04 inches in diameter to support its own gravitational loading. As will be obvious to one skilled in the art, the exact composition can be varied to suit the application.

Untapered rods of the general type described herein, which are greater than 7 feet in length exhibit more deflection and instability due to self-loading than is desirable in an antenna. In order to retain the deflection, stability and self-erection properties of the present invention to a height of 8 feet, the rod used in the preferred embodiment was linearly tapered from a nominal 0.06 inches in diameter at a point 2 feet from the base to 0.02 inches at the other end. The taper is shown on the upper segment of antenna element 10 in FIG. 4 but is exaggerated in degree in order to preserve clarity in view of the scale of the drawing. Rods used in devices embodying the present invention may be tapered by centerless grinding which is well known in the art and which, therefore, will not be described further. Such centerless grinding is availabe, for example, from Lynco, Los Angeles, Calif., and from Baltimore Grinding, Baltimore, Md.

As demonstrated in wind tunnel tests of an antenna structure incorporating the 8 foot tapered rod of the above described preferred embodiment, exposure to 60 mph wind causes the antenna rod to bend parallel to the force of the wind at a point about 2 feet above the point of attachment. Once the wind ceases, the antenna will right itself thus "healing" any flexure-caused degradation in radiating ability. This degree of self-healing capability is not found in the other self-erecting antennas discussed above.

It will be understood by those skilled in the art that other composite materials such as beryllium fiber, boron fiber, Kevlar (T.M.) fiber, and glass fiber could be employed in an antenna structure comprehended by the present invention. It would also be understood that the choice of electrically conductive graphite fiber in the preferred embodiment eliminates the need for the use of a wire conductor, a conductive resin, or other expedient that might be required to provide the necessary conductive properties in antennas fabricated of nonconductive types of fiber. Likewise, it would be obvious to one skilled in the art to use a different degree of taper or no taper depending upon the properties required of the antenna structure in a particular application.

In addition to the antenna element 10, FIG. 1 shows inner wall 13 and outer wall 11 of groove 12 within which antenna element 10 is coiled in device 14. Restraining pin 26, which prevents erection of the antenna structure and allows for triggering of erection, is shown in cross-section. The basal end of antenna element 10 is physically connected by means of ferrule 16 to device 14. It will also be obvious to one skilled in the art that antenna element 10 may have to be electrically isolated from device 14, for example, in the preferred embodiment, by the use of a dielectric ferrule. This then would allow the antenna to be electrically driven from or connected to electronics which may, for example, be a part of or be mounted within device 14. Surface 24 forms the rear wall of a cavity formed by a widened portion of groove 12 in which ferrule 16 lies.

Figure 2:
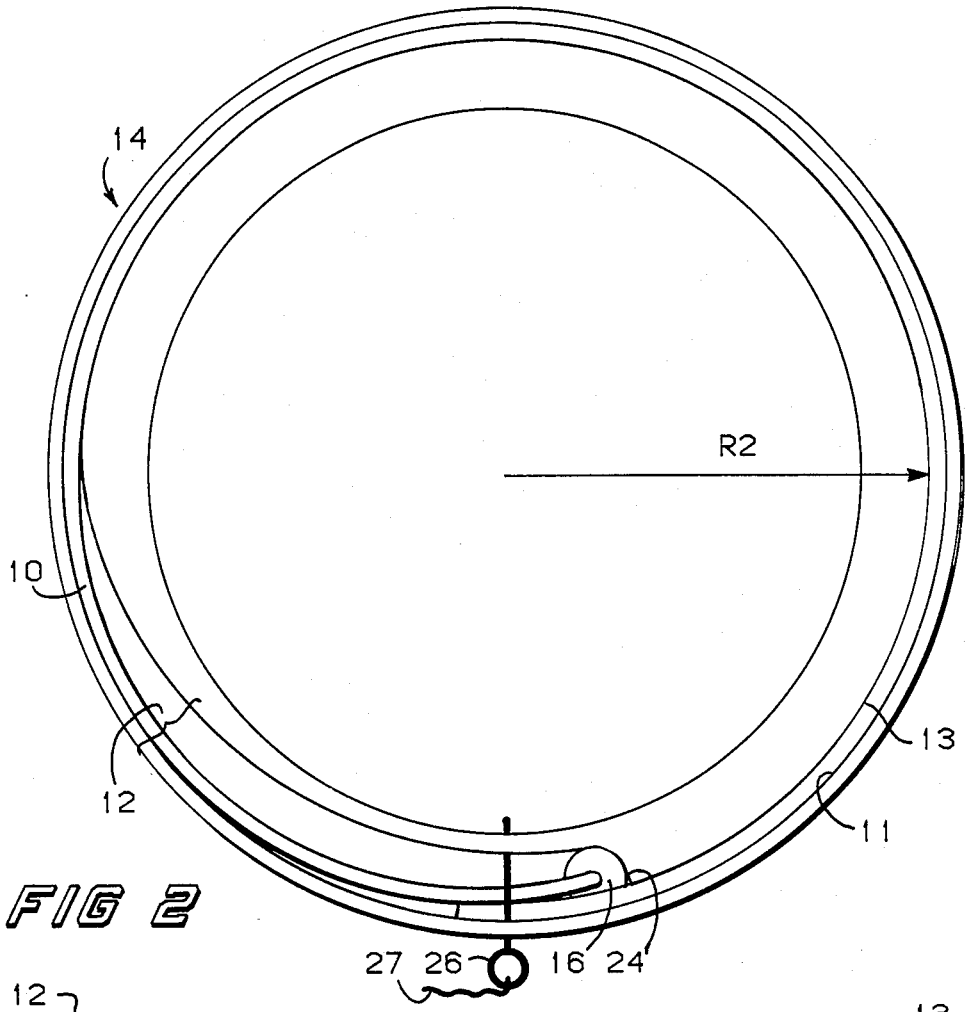
FIG. 2 is a top view of the embodiment of FIG. 1.

FIG. 2 is a top view of antenna element 10 as it appears when coiled within device 14. As shown in FIG. 1 the radius of curvature $R_1$ of the segment of antenna element 10 that is closest to ferrule 16 is greater than or equal to the radius of curvature $R_2$ of the antenna element 10 as it lies tightly coiled within device 14, as shown in FIG. 2.

When restraining pin 26 is pulled away from device 14 by the action of cord 27, antenna element 10 begins to uncoil. It will be understood by those skilled in the art that there are many other types of restraining systems as well as many other releasing methods that could be utilized within the scope of the present invention.

Figure 3:
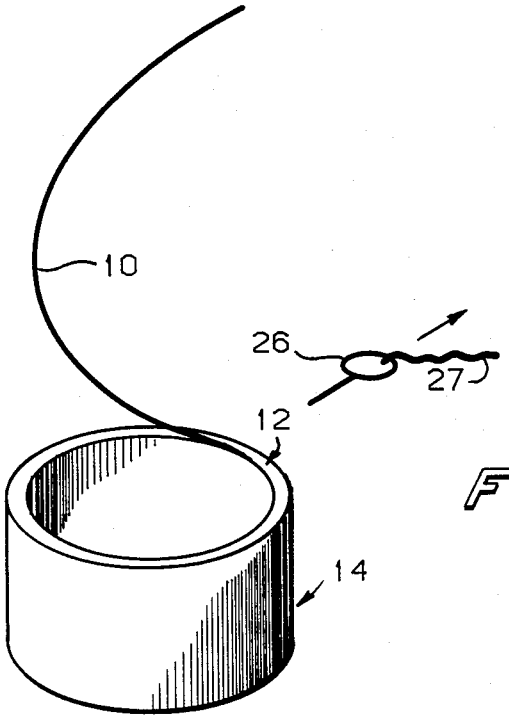
FIG. 3 is a perspective view of the embodiment of FIGS. 1 and 2 showing the antenna element during the process of erection.

An early stage of the uncoiling of antenna element 10 is depicted in FIG. 3. As illustrated in FIG. 3, groove 12 directs the uncoiling of antenna element 10 vertically and thus reduces horizontal travel of antenna element 10 that otherwise could result in collision of antenna element 10 with nearby objects. It should be clear that in embodiments of the present invention where such collision would not be an important factor, the antenna element could be stowed by being coiled externally on a mandrel. Stowage on a mandrel includes, for example, a capability to be stowed by coiling around a portable radio transmitter or receiver and a capability to be manually connected to the device as required. When not in use, the antenna could be disconnected and rewound around the device.

Figure 4:
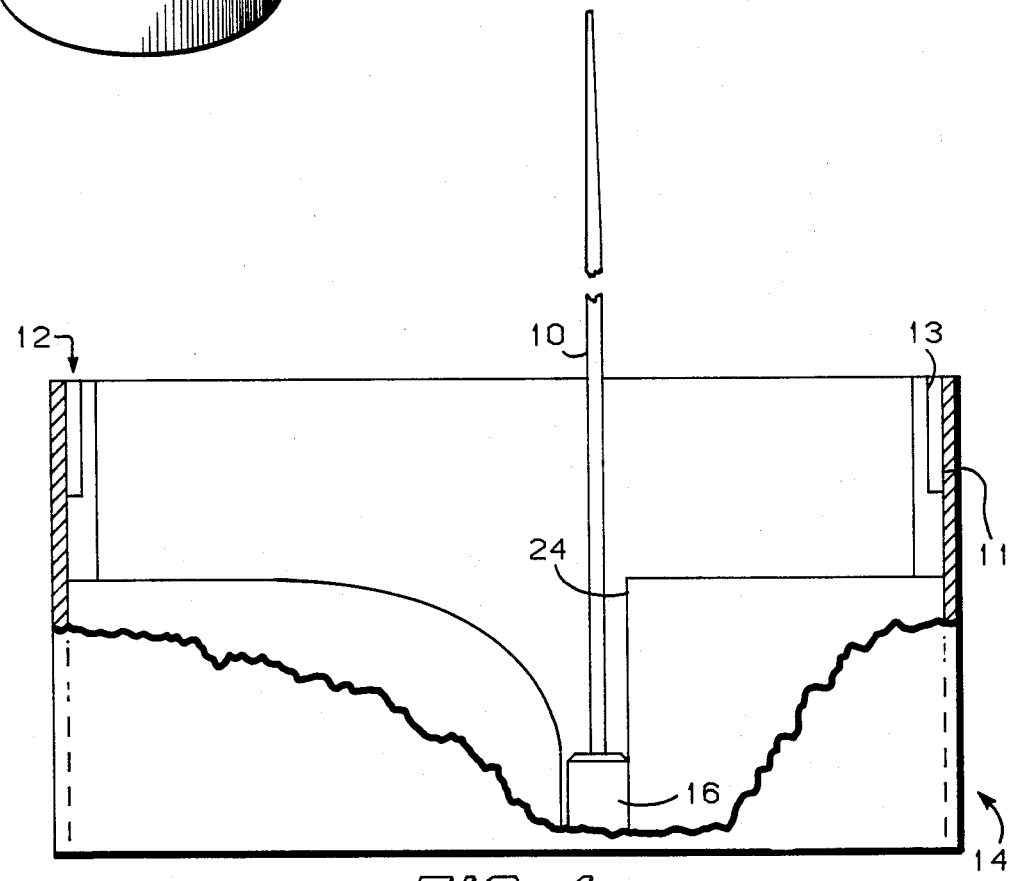
FIG. 4 is a side view of the embodiment of FIG. 1 with a portion of the outer surface cut away to reveal the antenna in its erect configuration.

When the uncoiling process progresses to the segment of antenna element 10 nearest ferrule 16, the release of strain energy in the uncoiling process will cause antenna element 10 to bear against surface 24, which serves to limit the forward motion of antenna element 10, with the result that, after some oscillation, antenna element 10 will come to rest in the upright position shown in FIG. 4. In FIG. 4, antenna element 10 is shown with the central portion broken away in order to depict it as clearly as possible in the limited amount of space available for illustration.

While the present invention has been described in terms of a preferred embodiment, further modifications and improvements will occur to those skilled in the art. We desire it to be understood, therefore, that this invention is not limited to the particular form shown and we intend in the appended claims to cover all such modifications which do not depart from the spirit and scope of this invention as herein described.

What is claimed is:

1. An antenna having a stored mode and an erected mode, said antenna comprising:

a solid, electrically conductive rod including a flexible material and a plurality of stiff fibers embedded in said flexible material so as to impart to said rod a flexural modulus of elasticity in a range of about $17.4\times10^6$ psi to about $20.6\times10^6$ psi and an average tensile strength in a range from about 280,000 psi to about 315,000 psi, said rod being capable of coiling into at least one complete loop in the stored mode and erecting into a vertical cantilever in the form of a substantially unbent column in the erected mode; and base means having said rod connected thereto adjacent one end, said base means including a portion constructed to receive said rod coiled into at least one complete loop in the stored mode and said base means serving to anchor the one end in the erected mode.

2. An antenna as claimed in claim 1 wherein the plurality of stiff fibers of said rod include graphite fibers.

3. An antenna as claimed in claim 2 wherein the flexible material of said rod includes a vinyl ester resin.

4. An antenna as claimed in claim 3 wherein the length of said rod is in the range of approximately 4 feet 10 inches to 8 feet and the diameter is in the range of approximately 0.04 inches to 0.06 inches.

5. An antenna as claimed in claim 4 wherein said rod is longitudinally tapered.

6. An antenna as claimed in claim 5 wherein said base means includes releasable restraining means for restraining said rod in the stored position until released and allowing the rod to self erect, using strain energy stored within said rod during coiling, upon release thereof.

* * * * *